US005174778A

United States Patent [19]

Lin

[11] Patent Number: 5,174,778

[45] Date of Patent: Dec. 29, 1992

[54] ELECTRONIC CONNECTOR

[76] Inventor: Tin-Huang Lin, 513 Minchih Rd., Sec. 3, Taishan Hsiang Taipei, Taiwan

[21] Appl. No.: 792,278

[22] Filed: Nov. 18, 1991

[51] Int. Cl.[5] ..... H01R 13/62

[52] U.S. Cl. ..... 439/326

[58] Field of Search ..... 439/296, 326-328, 439/629-637

[56] References Cited

U.S. PATENT DOCUMENTS

| | | | |
|---|---|---|---|
| 4,986,765 | 1/1991 | Korsunsky et al. | 439/326 |
| 4,995,825 | 2/1991 | Korsunsky et al. | 439/326 |
| 5,002,498 | 3/1991 | Takahashi | 439/326 |
| 5,004,429 | 4/1991 | Yagi et al. | 439/326 |

*Primary Examiner*—Joseph H. McGlynn
*Attorney, Agent, or Firm*—Fleit, Jacobson, Cohn, Price, Holman & Stern

[57] ABSTRACT

An electronic connector of the invention is used for linking together two printed circuit boards, such as a master printed circuit board and a peripheral interface circuit board. The electronic connector holds the circuit boards firmly, properly oriented and in good conductive contact, on a base platform. The connector has a leaf spring for inserting in a fixation mounting on a base platform. The leaf spring has a flexible, resilient die-pressed metal sheet body. An upper portion of the metal sheet body has a slanted face projecting forward adjacent a first side edge of the upper portion and a guide member extending downward from a lower edge of a second side edge of the upper portion and spaced away from said sheet body by a gap. A lower portion of the sheet body has a centrally located fixed semicircular forward projection having a point projecting forward therefrom and a pair of hooks extending forward and upward from adjacent a lower edge of the sheet body spaced on either side of and below the semicircular projection. The electronic connector is engaged with a fixation mounting of a base platform having a grooved guide wall for fixedly receiving the sheet body on one side of the groove in the guide wall and for receiving the guide member on the other side of the groove in the guide wall.

10 Claims, 4 Drawing Sheets

ELECTRONIC CONNECTOR

FIELD OF THE INVENTION

The invention relates to an electronic connector used for linking two printed circuit boards.

BACKGROUND OF THE INVENTION

Known electronic connectors are unable to maintain good conductivity between circuit boards when circuit boards are repeatedly inserted and removed from a computer. Known connectors are unstable and liable to be loosened, distorted or damaged in use.

FIG. 1 shows base platform A having a plurality of conductors B in place on the base platform. Circuit board C is obliquely inserted into groove Al of base platform A having conductors B positioned thereon. Insertion of circuit board C requires little effort. When circuit board C is fixed in upright position, perpendicular to the upper face of the base platform, the vertical fixation of the circuit board depends mainly on fixation mountings A2 which project upwardly from both ends of the base platform. Leaf springs A3 are installed slightly inward of fixation mountings A2. Fixation mountings A2 are molded together with base platform A, in one piece, by injection molding.

Bevel guide block A4 projects inwardly from an inward side of an upper edge of leaf spring A3. When circuit board C receives a force to move it to a vertical position from its slanted position, leaf springs A3 and bevel guide blocks A4 of leaf springs A3 are pushed aside until the circuit board reaches the fixed vertical position. To reach the fixed vertical position, circuit board C is pushed just past two bevel guide blocks A4. Leaf springs A3 are then restored to their original position by the resilience of the material used for the leaf springs. However, although circuit board C is fixed in a vertical position, it can bend and tilt as it receives force from conductors B. Bevel guide blocks A4 engage and support circuit board C in its upright position. Circuit board C and conductors B can be closely engaged to ensure good conductivity. In practical applications, retrieving and inserting an electronic circuit board is complicated, time consuming and must be done frequently.

To remove circuit board C from base platform A, leaf springs A3 are removed by hand so that removal of the circuit board is not hindered by bevel guide blocks A4. Then, electronic circuit board C, which has been supported by a full row of conductors B, springs back to the slant position and can be drawn easily from groove A1 of base platform A.

However, this conventional electronic connector (first generation) has defects and is not favored by the electronic industry. Electronic connectors are widely applied to computer equipment which needs to be of highly reliable quality and stability. High temperatures must be sustained and good insulation is essential. Electronic connectors made of L.C.P. (liquid crystal plastic) possess these characteristics. This raw material has great strength in the longitudinal direction of its injection molding but is weaker in the horizontal direction.

An electronic connector must be retrieved and inserted frequently and repetitively. Each time the electronic connector is retrieved and inserted, the leaf spring bends. When leaf spring A3 and base platform A are made of thin plastic material, the leaf springs are too fragile. When a user pushes on leaf springs A to retrieve circuit board C, a screwdriver may sometimes be used to push the leaf spring. In doing so the direction of the pushing force is in the horizontal direction in which the plastic leaf spring is weaker. A screwdriver is used because the space available in a computer is often insufficient for fingers to reach. When excessive force is applied to leaf spring A3, it is easily broken and circuit board C is unable to be maintained in its proper upright position. Circuit board C becomes loose, makes poor contact with conductors B and becomes useless. At that time base platform A must be replaced, which is time consuming and costly.

A second generation product, also of the prior art, is illustrated in FIG. 2. This second generation product was introduced to correct the defects of the first generation electronic connector of FIG. 1. This second generation electronic connector is very different from the first generation product described above. As shown in FIG. 2, leaf spring E, located between the fixed mountings at each end of base platform D, is made of pressed metal which has been formed into a fixed shape. After the pressed metal leaf springs E are shaped, they are inserted into fixed positions, adjacent fixed mounting D1, to lock the circuit board in fixed position. Leaf spring E includes face E1 which is bent backward. Beveled convex face E2 is attached to face E1 at one side. On a lower portion of the opposite side of leaf spring E, bent face E3 extends inward. The sheet body of leaf spring E is bent again in the reverse direction outwardly and upwardly. Thus, leaf spring E is bent into a "U" shape in an attempt to attain the proper degree of resilience. Assembly of leaf spring E with fixation mounting D1 in base platform D requires insertion of a lower part of the "U" shape into the groove of the fixation mounting. FIG. 2-1 shows leaf spring E in fixed position. Side face E3 engages the back of fixation mounting D1.

When a circuit board is inserted from the slant position to an upright position, the beveled convex face E2 of leaf spring E is pushed away until bevel convex face E2 engages and supports the circuit board in its correct position. The substitution of a metal leaf spring for a conventional plastic leaf spring resolves the problem of the easy breakage of the plastic leaf spring and its lack of durability. Although the second generation product is made of satisfactory material and is more convenient in use, defects still exist due to poor design with respect to the structure of leaf spring E and its coordination with fixation mounting D1. These defects include the following problems. Leaf spring E must first be pressed into the required shape and then a further process is required to bend it into a "U" shape. The shape is unduly complex and the processing is time consuming and uneconomical. The "U" shape uses an excessive amount of material in addition to needing costly processing.

Further, as shown in FIG. 2-1, gap X in the rebate within the fixation mounting is very large and allows leaf spring E to move excessively forward or backward when pushed by the user. Movement of leaf spring E is limited to the width of gap X of the rebate. This excessive movement produces metal fatigue in the "U" shaped portion of leaf spring E. Once metal fatigue appears, the resilience of leaf spring E deteriorates and its stability in clamping the circuit board likewise deteriorates. Ultimately, the circuit board loosens and contact is reduced.

Moreover, when the circuit board is pushed into the vertical position against leaf spring E, leaf spring E is also pushed. Leaf spring E receives longitudinal and horizontal forces and also simultaneously receives a component of force in the oblique direction (approaching 45°) as a result of the support between the circuit board and slant convex face E2 of leaf spring E. Thus, the face at the rear side of leaf spring E is inserted and secured in the groove of the fixation mount D1. The sheet body at the front side, adjacent slant convex face E2, is pushed and supported in an oblique direction so that the sheet body at the front side and the sheet body at the rear side bend and are distorted in oblique directions at opposite positions. After such frequent distortions, leaf spring E is permanently twisted and the fixation of the circuit board is adversely affected. The circuit board may be loosened and displaced, adversely affecting its contact and conductivity with the leaf spring.

SUMMARY OF THE INVENTION

An electronic connector of the invention is used for linking together two printed circuit boards, such as a master printed circuit board and a peripheral interface circuit board. The electronic connector has a leaf spring which provides improved performance and holds the circuit boards firmly, properly oriented and in good conductive contact, on a base platform.

The electronic connector has an improved leaf spring structure for inserting into a fixation mounting on a base platform. The leaf spring has a one-piece flexible, resilient die-pressed metal sheet body. An upper portion of the metal sheet body has a bevel boss extending upwardly, a slanted face projecting forward adjacent a first side edge of the upper portion and a guide member extending downward from a lower edge of a second side edge of the upper portion and spaced away from said sheet body by a gap. A lower portion of the sheet body has a centrally located fixed semicircular forward projection having a point projecting forward therefrom and a pair of hooks extending forward and upward from adjacent a lower edge of the sheet body spaced on either side of and below the semicircular projection.

An electronic connector of the invention is engaged with a fixation mounting. Fixation mountings are molded at each end of a base platform for receiving circuit boards. The forward projection in the lower portion of the sheet body of the leaf spring engages a groove of the base platform which limits the moveability of the leaf spring. The leaf spring is thus prevented from tilting inwardly and the correct insertion angle of the electronic circuit board is obtained. Deformation of the leaf spring by excessive outward bending is prevented.

The fixation mountings further include a grooved guide wall for receiving the sheet body on one side of the groove in the guide wall and for receiving the guide member on the other side of the groove in the guide wall. The grooved guide wall ensures that the leaf spring is fixed in position with little possible forward or backward movement.

The electronic connector is simple and economical to make using a single die pressing of a metal sheet. The system described is durable and the connector readily maintains good electronic conductivity.

It is an object of the invention to provide a simple, economical electronic connector having a one-piece die-pressed metal sheet body for fixedly inserting on a base platform for linking circuit boards together with good conductive contact.

BRIEF DESCRIPTION OF THE DRAWINGS

FIG. 2-1 is an enlarged detail of FIG. 2.

FIG. 4-1 is an enlarged detail of FIG. 4.

DETAILED DESCRIPTION OF THE INVENTION

An electronic connector of the invention is used for linking two printed circuit boards, for example, a master circuit board and a peripheral interface circuit board. The electronic connector provides improved performance in securing the inserted circuit board to the base platform with good conductivity therebetween. The electronic connector is inserted easily, with little labor cost.

Figure 1:
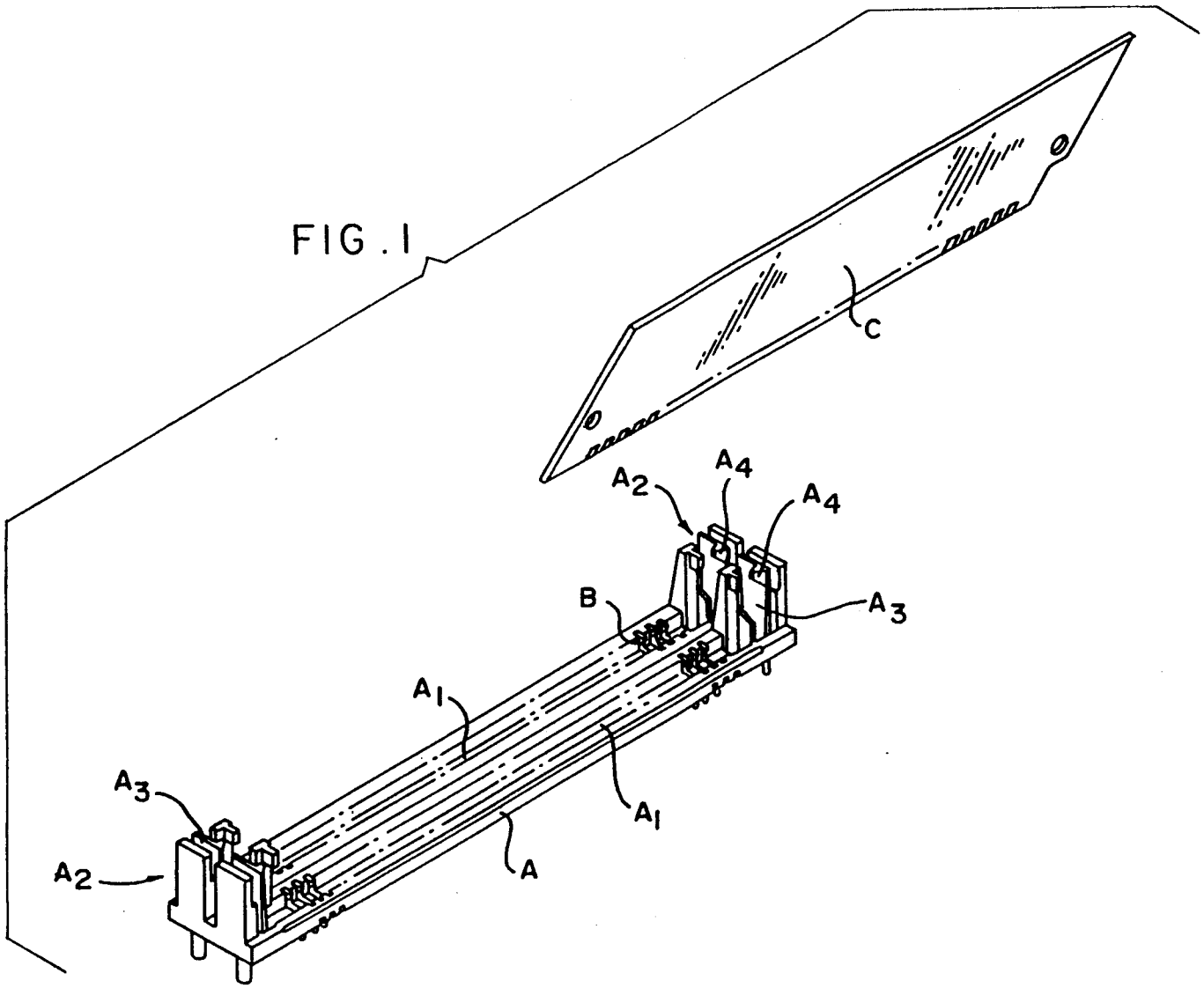
FIG. 1 is a perspective view of a base platform with a circuit board ready for installation, using a first generation electronic connector of the prior art.
Figures 2, 2A:
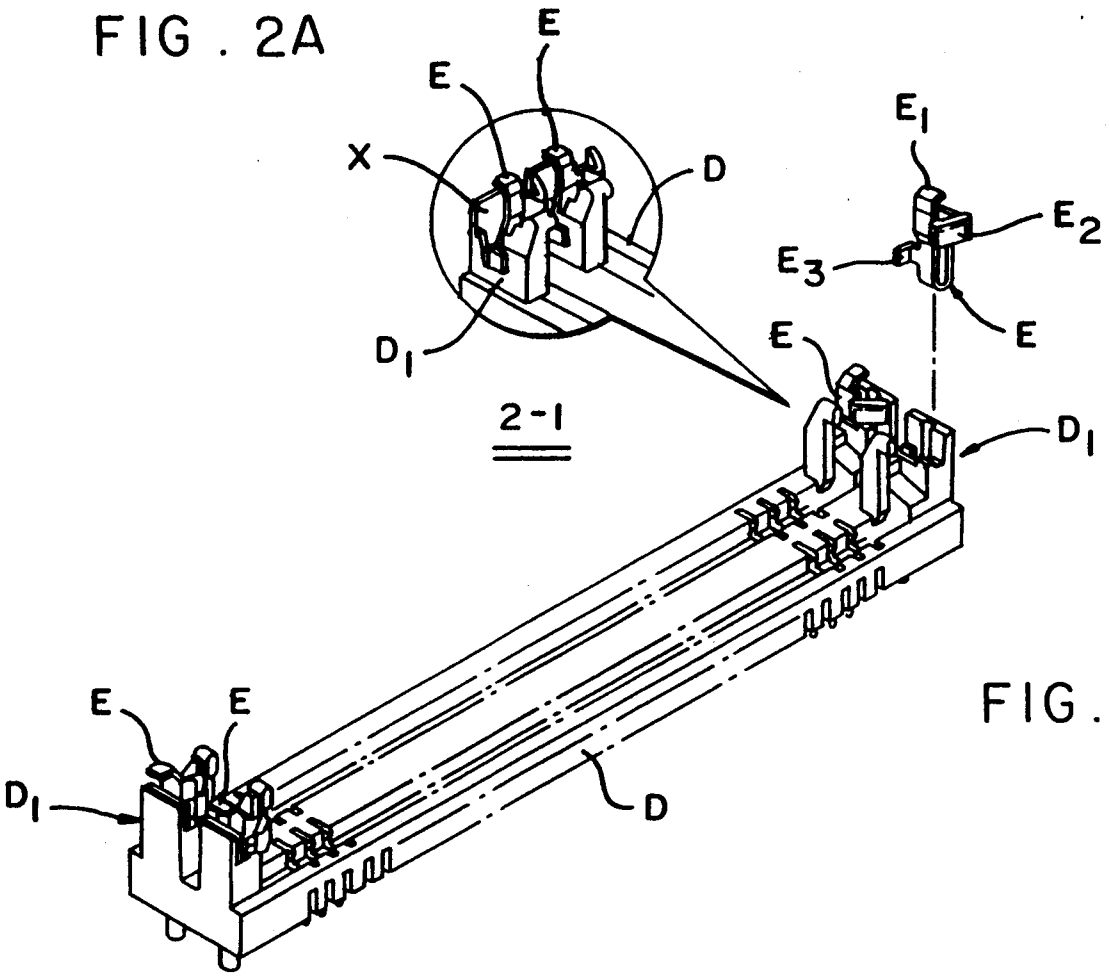
FIG. 2 is a perspective view of a base platform using a second generation electronic connector of the prior art.
Figure 3:
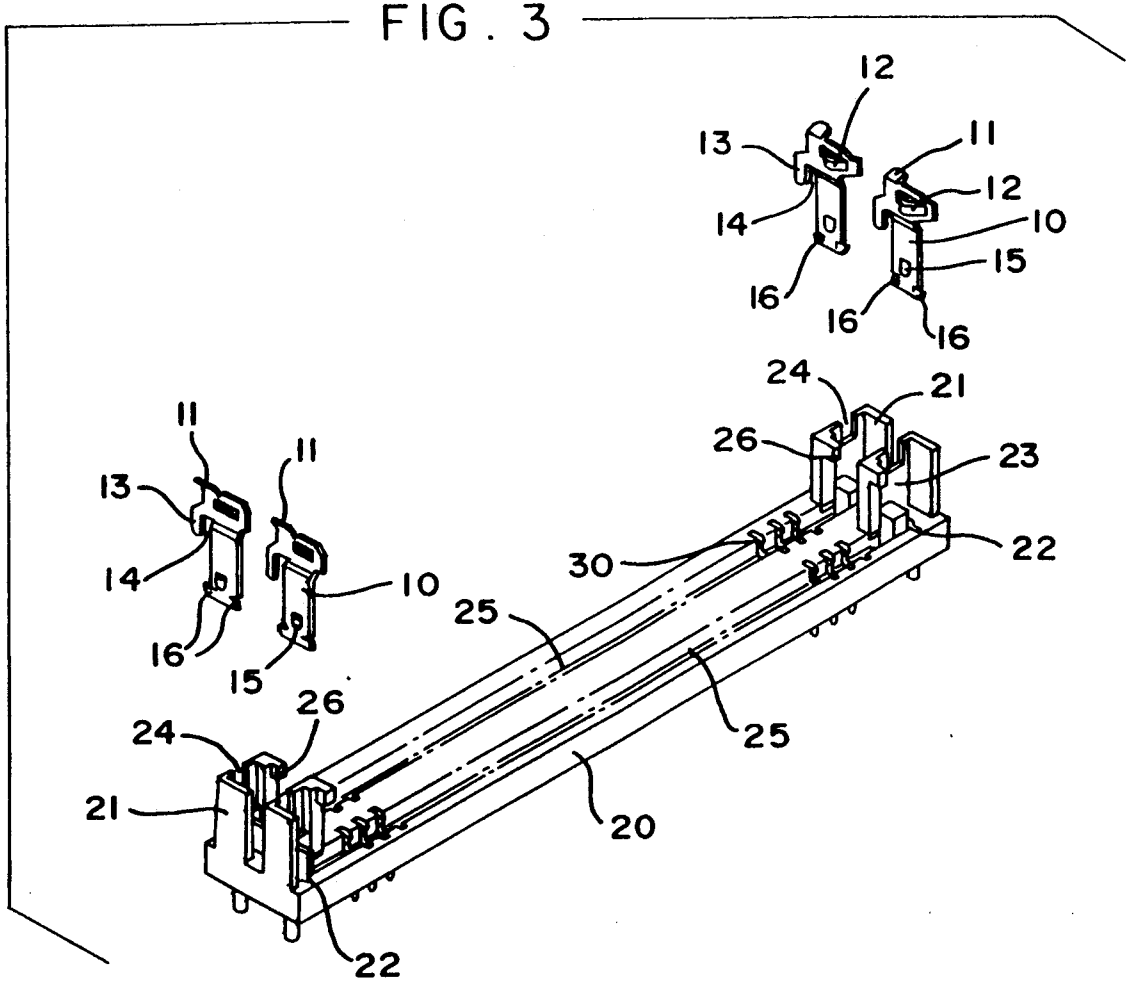
FIG. 3 is a perspective view of a base platform showing electronic connectors of the invention ready for insertion.
Figures 4, 4A:
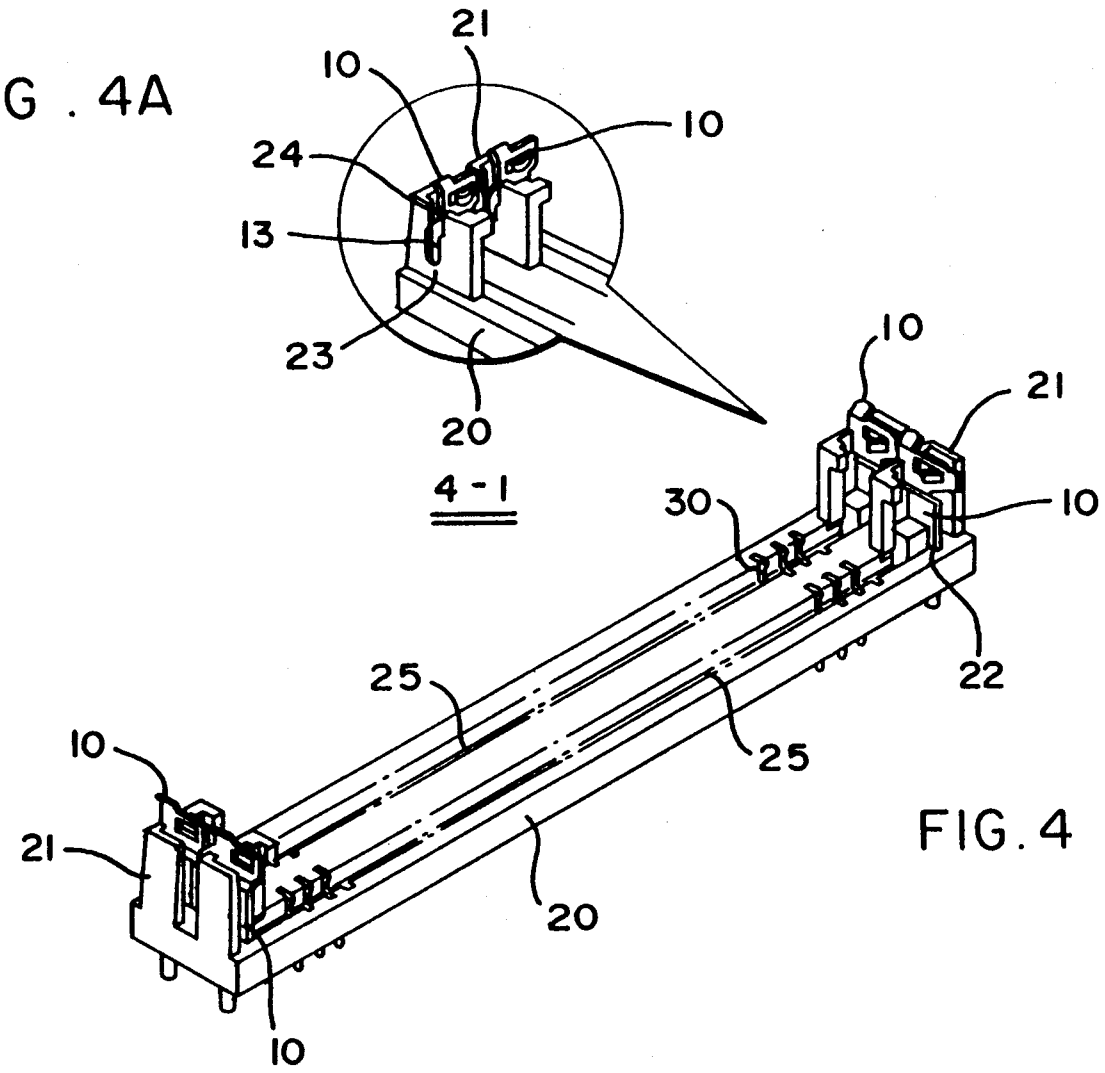
FIG. 4 is a perspective view of a base platform showing electrical connectors of the invention installed in place.

With reference to the Figures, in which like numerals represent like parts, FIGS. 1 and 2 illustrate the prior art and FIGS. 3 and 4 illustrate the invention.

In view of the defects mentioned above, an improved electronic connector is provided, as discussed below.

As shown in FIG. 3, leaf spring 10 of the electronic connector is secured in fixation mounting 21 on base platform 20. Leaf spring 10 is pressed from a metal sheet, by machine, in a single piece having good flexibility and resilience. The upper edge of leaf spring 10 includes bent face 11, bent backward away from the forward face of leaf spring 10. At one side of bent face 11, slant convex face 12 projects forward. At an opposite side of bent face 11, and in a lower position, guide member 13 extends downward. Gap 14 extends between guide member 13 and the main sheet body of leaf spring 10.

In a lower portion of the sheet body of leaf spring 10, a semi-circular fixation and convex point 15 is centrally located. Upwardly extending hooks 16 are located in the main body of leaf spring 10, one on each side of, and lower than, semi-circular fixation 15.

Leaf springs 10 are inserted on the left and right sides of base platform 20. Leaf spring 10 inserted in position on the left side of base platform 20 is identical in structure with leaf spring 10 inserted in position at the right side of platform 20. The leaf springs are symmetrically shaped for the right and left sides of the base platform and are mirror-images of each other.

Base platform 20 includes fixation mounting 21 extending upward at each end. Fixation mounting 21 includes a groove 22 cut in a lower portion thereof having a semi-circular hole at the center for clamping. Guide wall 23 extends inward from approximately a middle position of the back side of fixation mounting 21 and is of about the same height as fixation mounting 21. Concave groove 24 of an appropriate width (narrower than in the prior art) is cut into an upper edge of the back side of the fixation mounting, from top to bottom.

Concave groove 25 in base platform 24 receives a plurality of electrical conductors 30. Fixation members 26, for clamping and fixing the circuit board without displacement in the horizontal direction, project from a side of each fixation mounting 21. These are conventional structures and are not features of the present invention.

By means of the above structures, assembly of the system of the present invention is simple and convenient. As shown in FIGS. 3 and 4, leaf spring 10 is positioned vertically with semi-circular fixation and convex point 15 and hooks 16 in a lower portion and guide member 13 extending rearward. In this position, leaf spring 10 is directly inserted into clamping groove 22 of base platform 20. Semi-circular fixation and convex point 15 of leaf spring 10 is positioned into the semi-circular hole in the middle of clamping groove 22 of base platform 20. When so placed, the two inverted hooks 16 of leaf spring 10 are clamped and engaged at the bottom of clamping groove 22. Thus, leaf spring 10 is fixed in position by the semi-circular fixation and convex point 15 and is secured thereby and clamped in position by upwardly extending hooks 16. This insertion and fitting is achieved in a very precise and firm manner to achieve the proper location for the leaf spring. There can be no loosening or shaking with this inserting and fitting process. There is a clamping and securing effect by the reverse direction of the fixation, due to the inverted hooks 16. The device is not easily pulled out after leaf spring 10 is inserted in its fixed position. Thus leaf spring 10 and base platform 20 are firmly connected for long durability.

The lower portion of leaf spring 10 is inserted into fixation mounting 21 of base platform 20. Observing the connection from the rear of the fixation mounting 21, as shown in FIG. 4-1, it can be seen that guide member 13 of leaf spring 10 extends just outside guide wall 23 at the back of fixation mounting 21. Guide wall 23 extends into gap 14 in leaf spring 10. Guide wall 23 provides a directional guide to locate leaf spring 10 properly while the leaf spring is being inserted vertically into position. When the circuit board is inserted, slanted projecting face 12 receives the pushing and supporting force. As slanted projecting face 12 is bent in a convex shape, there is no concern that the circuit board might be damaged by scraping by face 12. Whatever force is received by the slanted projecting face 12, whether in longitudinal, horizontal or oblique direction, leaf spring 10 can maintain forward and backward movements in a "straight line" when it is pulled and bent. In this way, leaf spring 10 has no slant inclination and is not distorted or damaged. The fixed position of the leaf spring is not affected and there is no deviation, thus ensuring the clamping of the circuit board in a tight, solid and stable position. Further, the design of guide wall 23, in comparison with the rear side of fixation mounting D1 (in the conventional base platform shown in FIG. 2) enables leaf spring 10 to be guided correctly. Guide wall 23 has a reinforcing effect to make fixation mounting 21 firmer and also to prevent fixation member 26, shown in FIG. 3, from being easily broken. In a conventional unit, the fixation member is readily broken. Thus, the durability of the electric connector is increased.

FIG. 4-1 shows a detail of the installation. Concave groove 24 on the back of fixation mounting 21 is less wide than in the conventional mounting (shown in FIG. 2). The sheet body of leaf spring 10 extends and is located within the concave groove. The smaller width of concave groove 24 restricts the extent of forward and backward movement of leaf spring 10. Under conditions when there is no external force, leaf spring 10 is fitted in fixed position to the groove wall at the front side of concave groove 24. In that position, leaf spring 10 clamps the circuit board in its most correct and stable position. By means of the "fixation of position" of the groove wall at the front side, the circuit board is clamped tightly and closely by leaf spring 10, in the correct position. (Conversely, if leaf spring 10 were to incline inwardly too much, the clamping of the circuit board in its upright position would be affected so as to result in loosening and poor contact). Further, the rear side wall of concave groove 24 of fixation mounting 21 restricts leaf spring 10 from inclining outward too much if so forced. Thus, the forward and backward movements of leaf spring 10 are limited by the size and shape of concave groove 24. Further, leaf spring 10 can bend outwardly sufficiently to facilitate the entry or retrieval of the circuit board. Such bending is within the bending tolerance of leaf spring 10 without causing distortion, loosening or metal fatigue. Good clamping and rebound is maintained. This enables the circuit board to be fixed in the correct position for proper electrical conductive function.

The advantages of the present invention are summarized below.

The overall structure of leaf spring 10 is obtained in a single process of die-pressing a metal sheet. This is in contrast to a conventional metal leaf spring which must be die-pressed first and then subjected to a bending process for forming its shape. A leaf spring of the invention is made both more quickly and more easily than a conventional leaf spring. The structure of the invented leaf spring is both simple and accurate to reproduce with a saving in material used. The connector described is made more economically than a prior art device.

Guide walls 23, at the back of fixation mounting 21 on both ends of base platform 20 fit together with guide member 13 and gap 14 to ensure that leaf spring 10 moves forward and backward in a straight line without any deviation and to ensure that there is no distortion or deformation. In contrast, when using a conventional leaf spring and fixation mounting, the leaf spring can easily move out of place in its forward and backward movements because there is no structure to guide and grip the fixation mounting firmly to avoid distortion of the leaf spring. The electrical connector of the present invention ensures tight and close clamping of the circuit board by the leaf spring so that the circuit board does not tilt or loosen, thus enabling good conductivity. At the same time, guide wall 23 has the effect of reinforcing the system to avoid distortion and cracking of fixation mounting 21 and fixation member 26.

Concave groove 24 at the rear of the fixation mounting on both ends of base platform 20 restricts the extent of forward and backward movement of leaf spring 10 to keep leaf spring 10 firmly in position, without becoming loose as a result of successive pull. Distortion is also avoided. In contrast, a conventional fixation mounting allows a great amount of forward and backward movement of leaf spring 10, allowing loosening and distortion of the leaf spring. According to the invention, correct and proper clamping of the leaf spring against the circuit board ensures tight and close contact between the circuit board and the conductors and enables good conductivity with the electronic connector.

The electronic connector of the present invention corrects many defects shown in the electronic connectors of the first and second generations by the improved structure described herein.

While the invention has been described above with respect to certain embodiments thereof, it will be appreciated that variations and modifications may be made without departing from the spirit and scope of the invention.

What is claimed is:

1. An electronic connector comprising a leaf spring for inserting in a fixation mounting of a platform, said leaf spring including a flexible, resilient metal sheet body wherein:

an upper portion of said sheet body comprises a slanted face projecting forward of a first side edge of said upper portion and a guide member extending downward from a lower edge of said upper portion adjacent a second side edge thereof spaced away from a lower portion of said sheet body by a gap, and a lower portion of said sheet body comprises a fixed projection and a pair of hooks extending from said lower portion spaced on either side of and below said fixed projection.

2. An electronic connector according to claim 1 further comprising a beveled boss extending upward from an upper edge of said upper portion of the sheet body.

3. An electronic connector according to claim 2 wherein said beveled boss extends rearward from said upper portion.

4. An electronic connector according to claim 1 wherein said slanted face projects forward adjacent said first side edge of said upper portion.

5. An electronic connector according to claim 1 wherein said fixed projection extends forward of said lower portion of said sheet body.

6. An electronic connector according to claim 5 wherein said fixed projection includes a point extending forward of said lower portion of said sheet body.

7. An electronic connector according to claim 6 wherein said fixed projection is shaped substantially as a semicircle.

8. An electronic connector according to claim 1 wherein said fixed projection is centrally located between and above said pair of hooks.

9. An electronic connector according to claim 8 wherein said pair of hooks extend upward from adjacent a lower edge of said sheet body.

10. An electronic connector comprising a leaf spring for inserting in a fixation mounting on a base platform, said leaf spring including a flexible, resilient die-pressed metal sheet body comprising:

an upper portion comprising a slanted face projecting forward adjacent a first side edge of said upper portion and a guide member extending downward from a lower edge of a second side edge of said upper portion and spaced away from said sheet body by a gap, and a lower portion comprising a centrally located fixed semicircular forward projection having a point projecting forward therefrom and a pair of hooks extending forward and upward from said sheet body spaced on either side of and below said semicircular projection, wherein said electronic connector is engaged with a fixation mounting of a base platform having a grooved guide wall for fixedly receiving said sheet body on one side of the grooved guide wall and said guide member on the other side thereof.

* * * * *